US006651722B1

(12) United States Patent
Fleishman et al.

(10) Patent No.: US 6,651,722 B1
(45) Date of Patent: Nov. 25, 2003

(54) ARCHED BLIND FOR SEMICIRCULAR ARCHED WINDOW

(76) Inventors: Ron Fleishman, 1225 Tamiami Trail, Port Charlotte, FL (US) 33953; Lorraine Fleishman, 1225 Tamiami Trail, Port Charlotte, FL (US) 33953

( * ) Notice: Subject to any disclaimer, the term of this patent is extended or adjusted under 35 U.S.C. 154(b) by 0 days.

(21) Appl. No.: 10/254,390

(22) Filed: Sep. 25, 2002

Related U.S. Application Data

(63) Continuation of application No. 09/845,124, filed on Apr. 30, 2001, now Pat. No. 6,390,172.

(51) Int. Cl.[7] ..... E06B 9/30

(52) U.S. Cl. ..... 160/168.1 V; 160/84.07; 160/84.01

(58) Field of Search ..... 160/168.1 V, 168.1 R, 160/84.01, 84.07, 176.1 V, 177, 900

(56) References Cited

U.S. PATENT DOCUMENTS 4,556,095 A * 12/1985 Lewis ..... 160/166 R
4,776,380 A * 10/1988 Lester ..... 160/134
4,934,436 A * 6/1990 Schnelby ..... 160/84.1
5,044,418 A * 9/1991 Donahue ..... 160/330
5,086,822 A * 2/1992 Keighler ..... 160/38
5,159,966 A * 11/1992 Fleischman et al. ..... 160/84.1
5,183,092 A * 2/1993 Jelic ..... 160/84.1
5,632,316 A * 5/1997 Cohen ..... 160/168.1
5,662,153 A * 9/1997 Rosenblatt ..... 160/84.07
5,765,619 A * 6/1998 Arnold ..... 160/84.07
5,794,680 A * 8/1998 Xue ..... 160/84.07
5,820,189 A * 10/1998 Tew ..... 296/26
5,823,241 A * 10/1998 Sitzes et al. ..... 160/107
6,029,733 A * 2/2000 Xue ..... 160/84.07
6,062,291 A * 5/2000 Morgan et al. ..... 160/176.1 R
6,145,569 A * 11/2000 Shaw et al. ..... 160/84.07
6,341,447 B1 * 1/2002 Jean ..... 49/74.1
6,390,172 B1 * 5/2002 Fleischman et al. .. 160/168.1 V

* cited by examiner

*Primary Examiner*—Bruce A. Lev
(74) *Attorney, Agent, or Firm*—Frank A. Lukasik

(57) ABSTRACT

A blind for an arched window and more specifically a fan-type blind for semicircular arched windows in the form of an adjustable vertical slat-type blind for a semicircular arched window opening being constructed from semi-rigid material such as plastic or fabric-type material formed by a plurality of vertical blades rotatably suspended from a plurality of sprocket-chain driven shafts radially attached to a semicircular support frame consisting of a curved "U" section and a horizontally disposed mounting rail forming the bottom of the blind for mounting the unit. A second embodiment includes blind slats variously affixed at their proximal ends, using an attachment such as hook and loop (VELCRO). A third embodiment includes trimming a second end of the slats to remove length and bulk to fit within the supporting strip.

10 Claims, 25 Drawing Sheets

ARCHED BLIND FOR SEMICIRCULAR ARCHED WINDOW

This application is a continuation of application Ser. No. 09/845,124 filed Apr. 30, 2001, now U.S. Pat. No. 6,390,172 B1 issued May 21, 2002 to Fleishman.

BACKGROUND OF THE INVENTION

1. Field of the Invention

The present invention generally relates to a blind for an arched window and more specifically an adjustable blind for semicircular arched windows in the form of a semicircular frame supported along its bottom edge by a mounting rail which is supported by end mounting brackets attached to a window casing. The vertically hanging blind slats are attached to a plurality of rotatable mounts having serrated, slotted or otherwise configured openings which engage an endless ball chain having an attachment/guiding means whereby the chain is kept in range of a person's reach so they may pull on said chain to effect blind adjustment.

2. Description of the Prior Art

Windows, and in some instances, doorways are frequently provided with a semicircular arched window at the top of the usually provided rectangular window or doorway. Conventional arched windows are designed to meet both ornamental and functional needs. In addition to the ornamental architectural aspects, arched windows create a feeling of openness, enlarge the outside view and increase the level of natural interior illumination.

In many arched window installations, it is desirable to regulate or limit the amount of sunlight that passes through the arched window. For example, the occupant may desire to cover all windows for privacy reasons, or reduce the ambient light of a bedroom to accommodate a day sleeper.

Adjustable arched blinds have been provided for arched windows. The following U.S. patents illustrate the prior art in this field of endeavor.

U.S. Pat. No. 5,794,680
U.S. Pat. No. 5,765,619
U.S. Pat. No. 5,662,153
U.S. Pat. No. 5,117,889
U.S. Pat. No. 5,044,418
U.S. Pat. No. 4,934,436
U.S. Pat. No. 4,776,380
U.S. Pat. No. 6,029,733
U.S. Pat. No. 5,159,966 Issued Nov. 3, 1992 to Fleishman Fleishman's patent discloses a fan-type blind of radial pleated construction. The blind disclosed is not intended to be adjusted as a regular function of its design, it is however adjustable so as to accommodate irregular window casings.

The present invention is an improvement on Fleishman's and the other inventions in that it is of simpler and less expensive construction while providing an attractive adjustable and functional method of covering and decorating a semicircular window opening.

SUMMARY OF THE INVENTION

An object of the present invention in one of its embodiments is to provide an adjustable vertical slat-type blind for a semicircular arched window opening being constructed from semi-rigid material such as plastic or fabric-type material formed by a plurality of vertical blades rotatably suspended from a plurality of sprocket—chain driven shafts radially attached to a semicircular support frame consisting of a curved "U" section of plastic or other flexible material and a horizontally disposed mounting rail forming the bottom of the blind for mounting the unit within the arched window opening.

Another object of the present invention is to provide a convenient means whereby the blind slats may be rotated by use of an endless ball chain having a lower loop running through a guide/support means which allows one side or other of the chain loop to be pulled by the operator to rotate the blind slats.

Another object of the invention is to provide a blind in accordance with the preceding object in which a decorative semi circular skirt is positioned within the window opening against the mounting rail to conceal the mounting rail and enhance the appearance characteristics of the blind assembly.

Another object of the invention is to provide a blind in accordance with the preceding objects in which the blind slats are suspended at their top by a hook of suitable shape through a slot positioned such that the blind can be rotated without interference with either the semicircular window opening or with a neighboring vertical slat.

Another object of the invention is to provide a blind in accordance with the preceding objects in which the blind slats are suspended at their top by an adjustable ball chain through a slot positioned such that the blind can be rotated without interference with either the semicircular window opening or with a neighboring vertical slat.

Another object of the invention is to provide a blind in accordance with the preceding objects in which the blind slats are adjustably attached suspended at their top through a plurality of radial slots and at their bottom ends by compression against each other and a decorative clamping means.

Another object of the invention is to provide a blind in accordance with the preceding objects in which the blind slats and decorative fascia are constructed from the same materials as the vertical blind covering the window itself Another object of the invention is to provide a blind in accordance with the preceding objects in which the blind assembly can be supplied in kit form or in completely assembled form.

Another object of the invention is to provide a blind in accordance with the preceding objects in which the blind slats are variously affixed at their proximal ends, either by attachment using a proprietary attachment means such as Velcro or in the alternative, by trimming each slat to allow it to fit within the limited space inside a base channel.

These together with other objects and advantages which will become subsequently apparent reside in the details of construction and operation as more fully hereinafter described and claimed, reference being had to the accompanying drawings forming a part hereof and wherein like numerals designate like and corresponding parts throughout the several views.

BRIEF DESCRIPTION OF THE DRAWINGS

FIG. 1 is an elevational view of the adjustable vertical blind window covering of the present invention.

FIG. 2 is an elevational view of the adjustable vertical blind window covering of the present invention with fascia components removed to reveal the support/adjustment means within.

FIG. 3 is a side elevation enlarged view of the sprocket/chain adjustment means of the present invention.

FIG. 4 is a side elevation enlarged view of the sprocket/chain adjustment means of the present invention.

FIG. 5 is a front elevational view of the sprocket/chain adjustment means of the present invention.

DESCRIPTION OF THE PREFERRED EMBODIMENT

Figure 1:
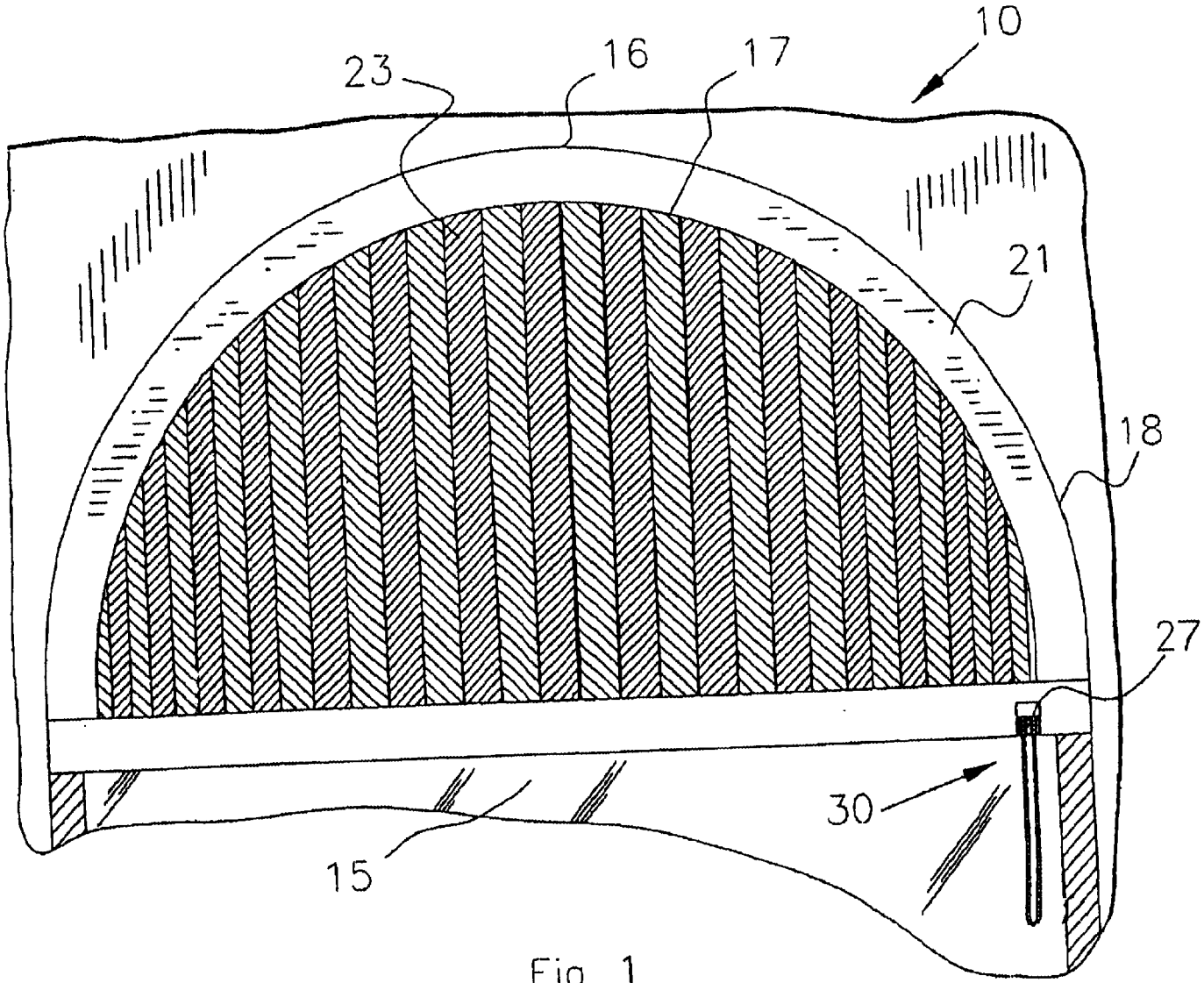
FIGS. 1–5 refer to the preferred embodiment and the first of a species comprising several variants of the arched window blind.

Referring now to the drawings wherein like numerals designate like and corresponding parts throughout the several views, in FIG. 1 the adjustable blind for semi-circular arched windows is generally designated by reference numeral 10 and is positioned in spaced parallel relation to an arched window 16 positioned above a conventional window 15 or above a doorway or the like with the arched window being received in a casing 18 and being of conventional construction.

The blind 10 of the present invention includes decorative facing 21 formed by a semi circular vinyl/plastic or other suitable material with an inner edge 17 extending sufficiently toward blind slats 23 to cover the mounting/adjustment hardware of blind 10.

Figure 2:
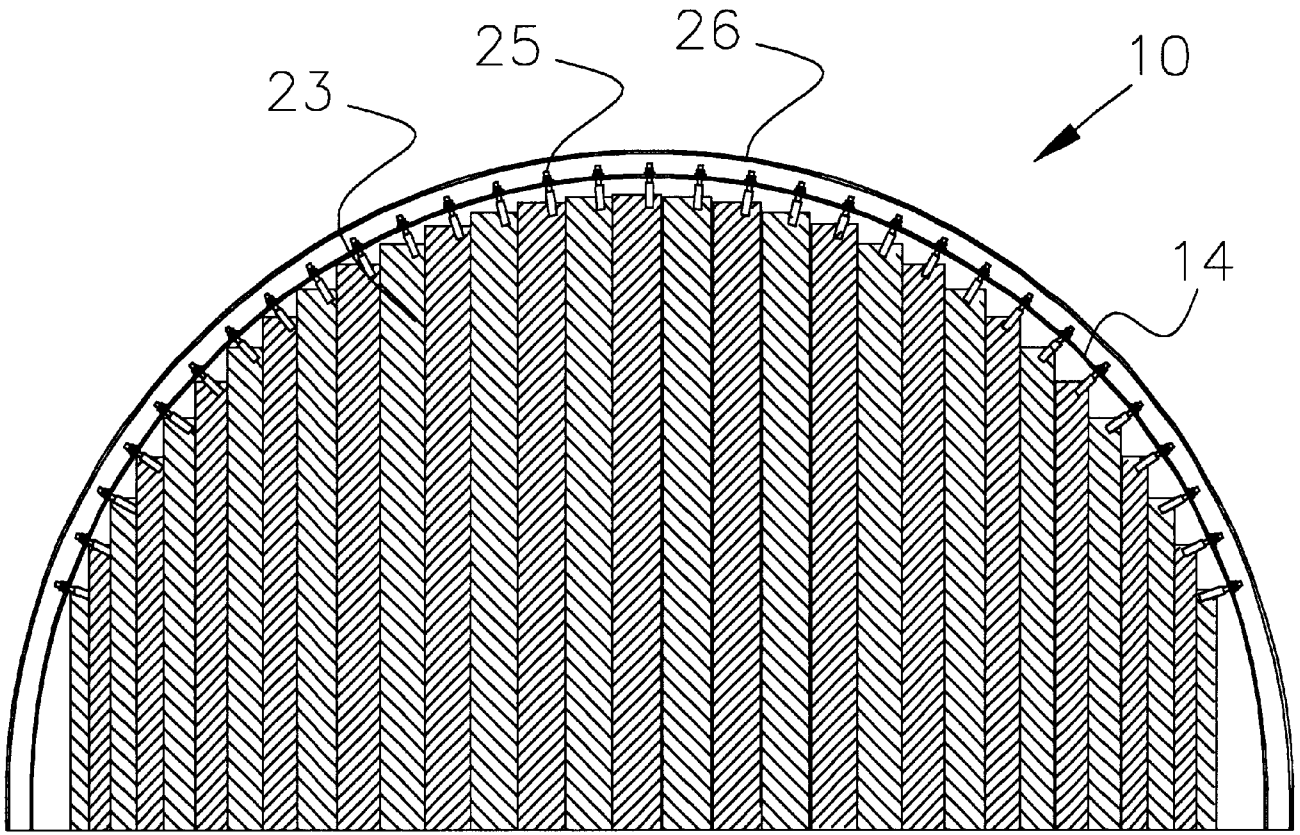
Figure 2A:
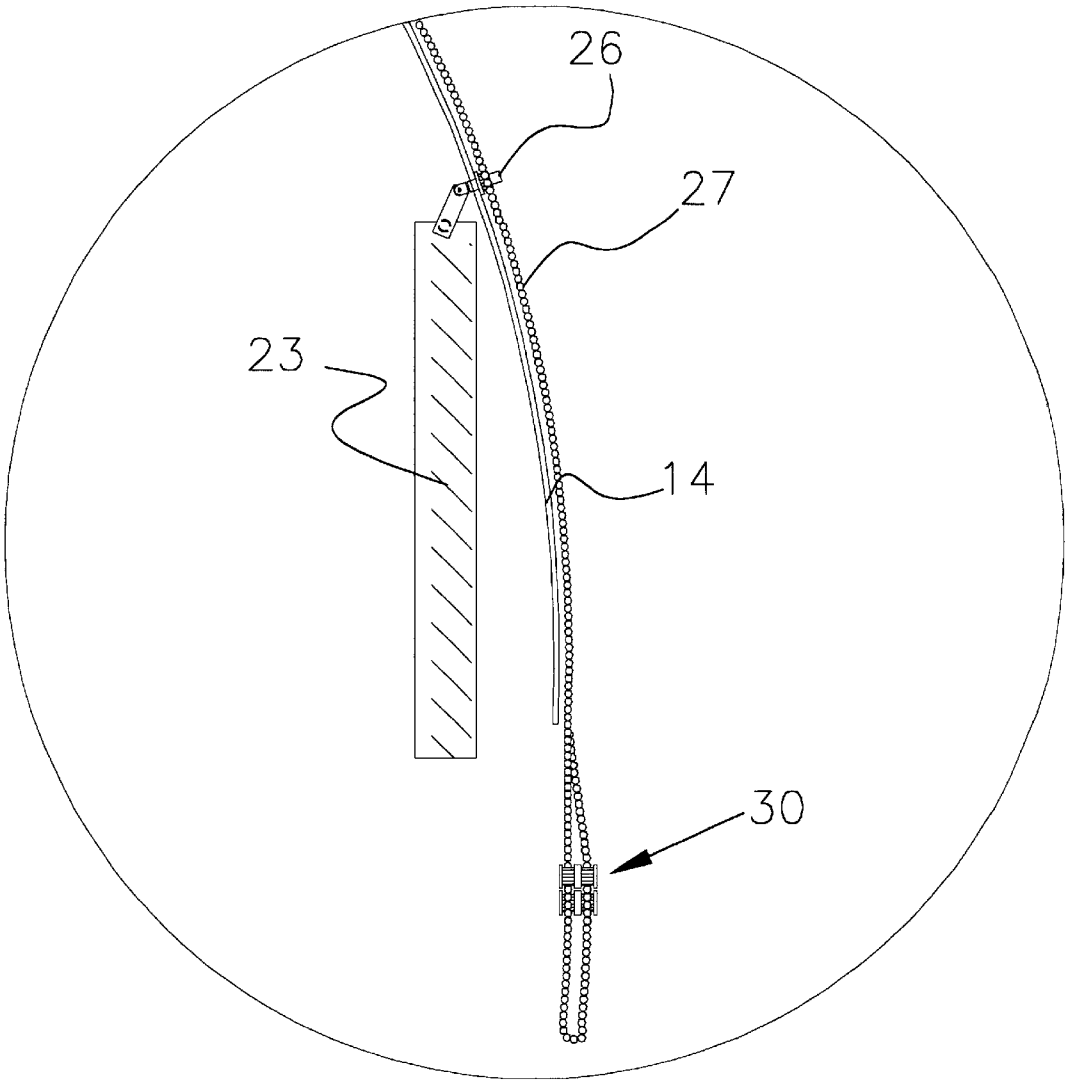
FIG. 2*a* is a diagrammatic enlarged view of the support/adjustment means of the present invention.
Figure 2B:
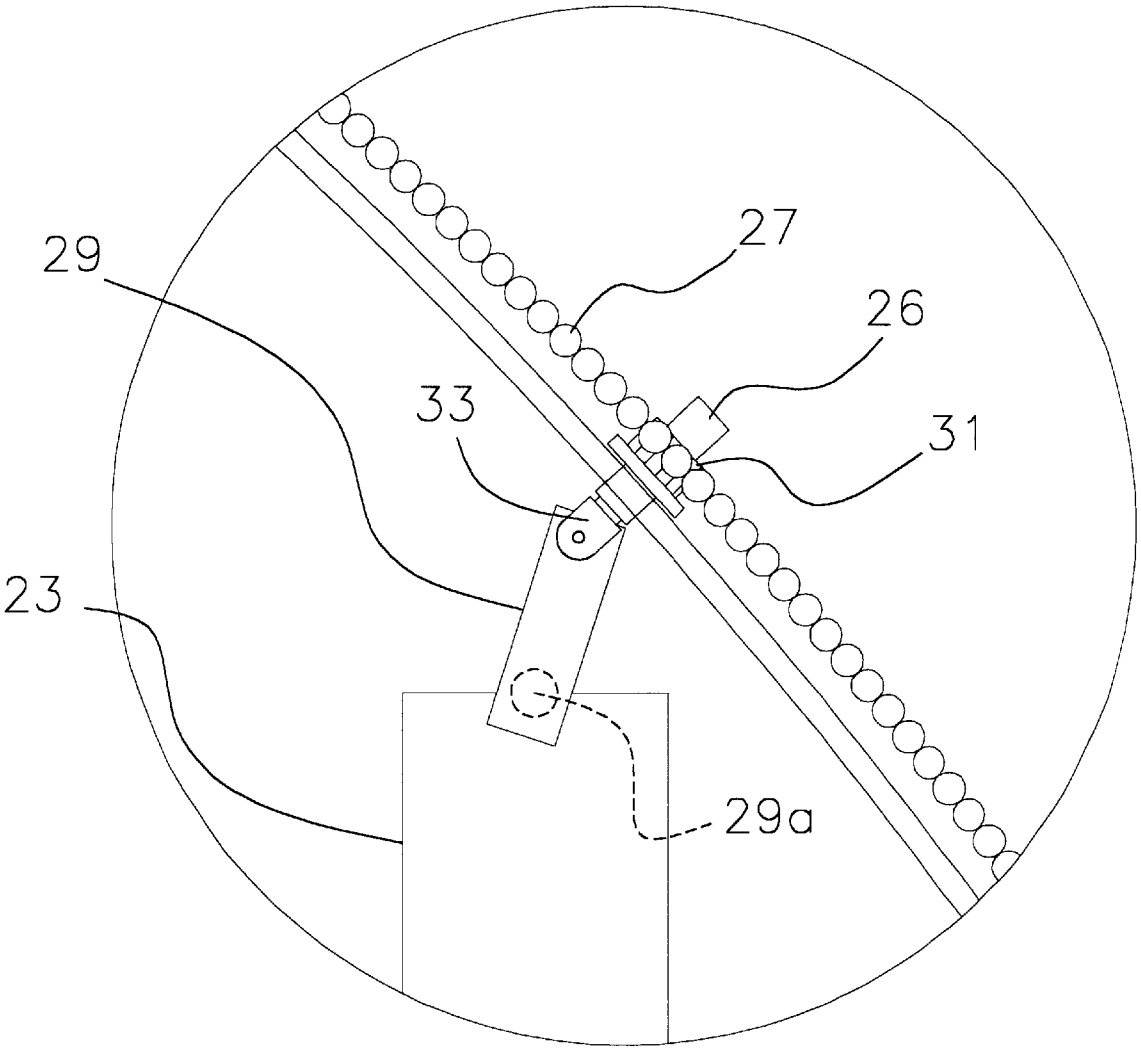
FIG. 2*b* is a further diagrammatic enlargement of the support/adjustment means of the present invention.
Figure 3:
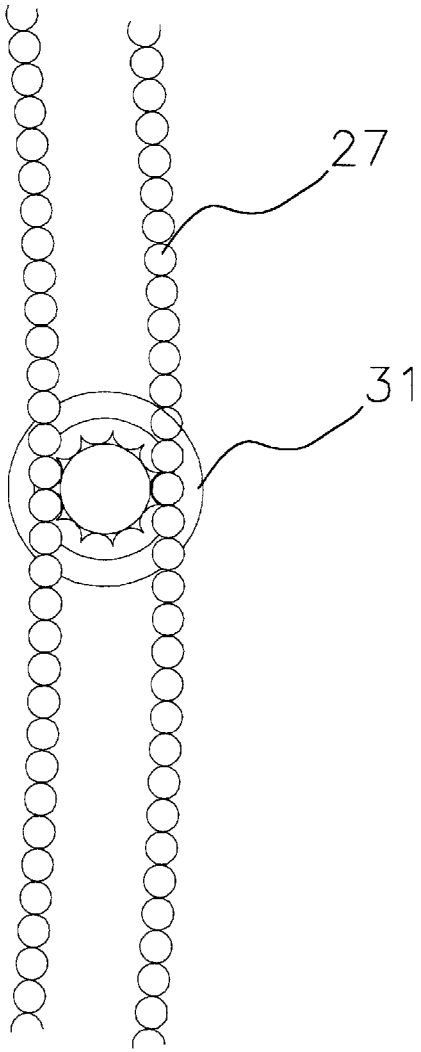
Figure 4:
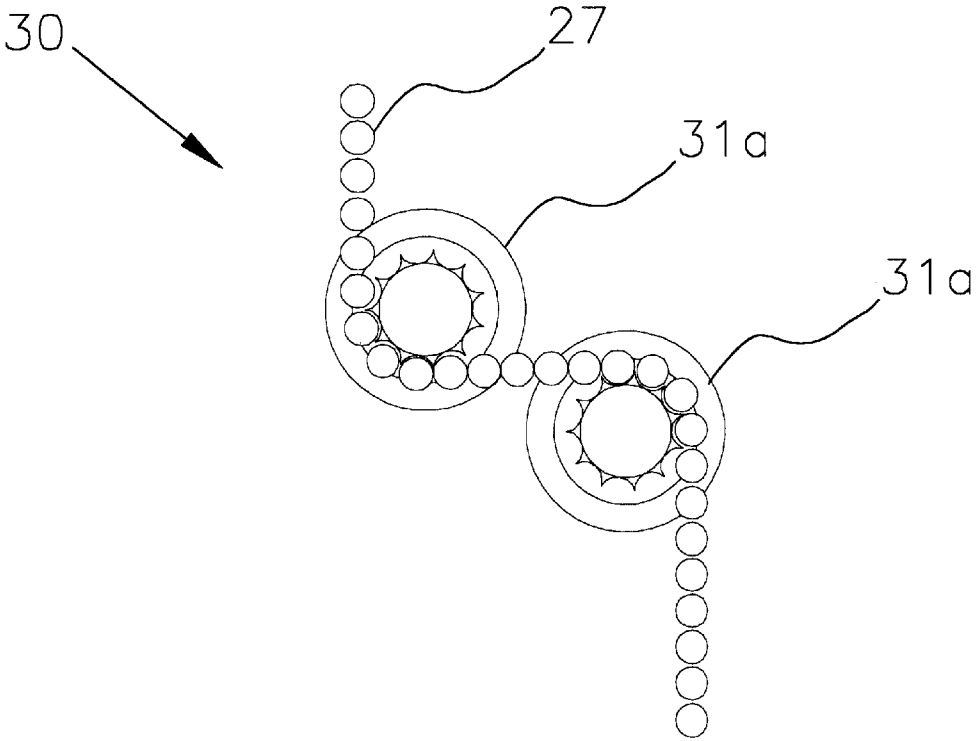
Figure 5:
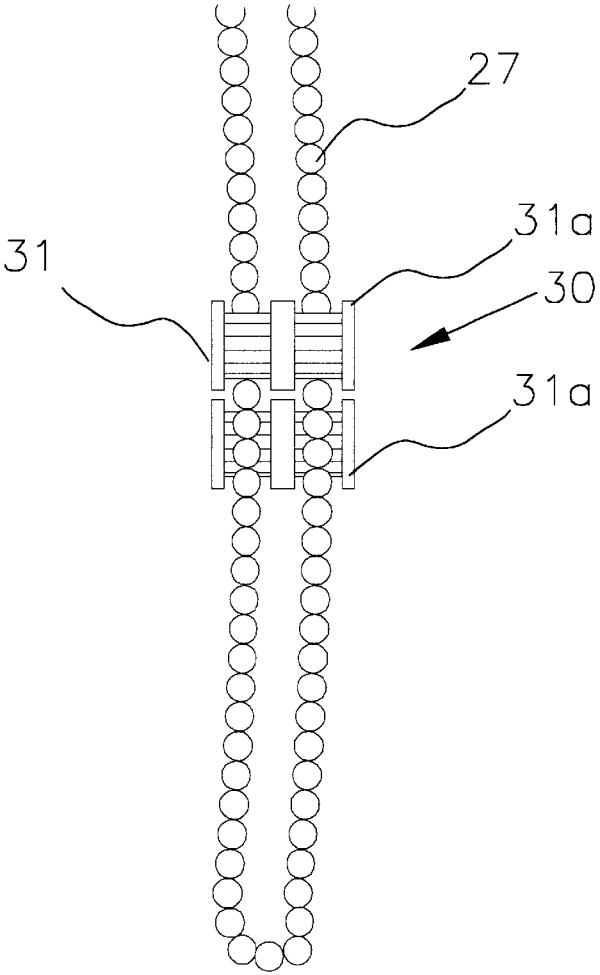
Figure 6:
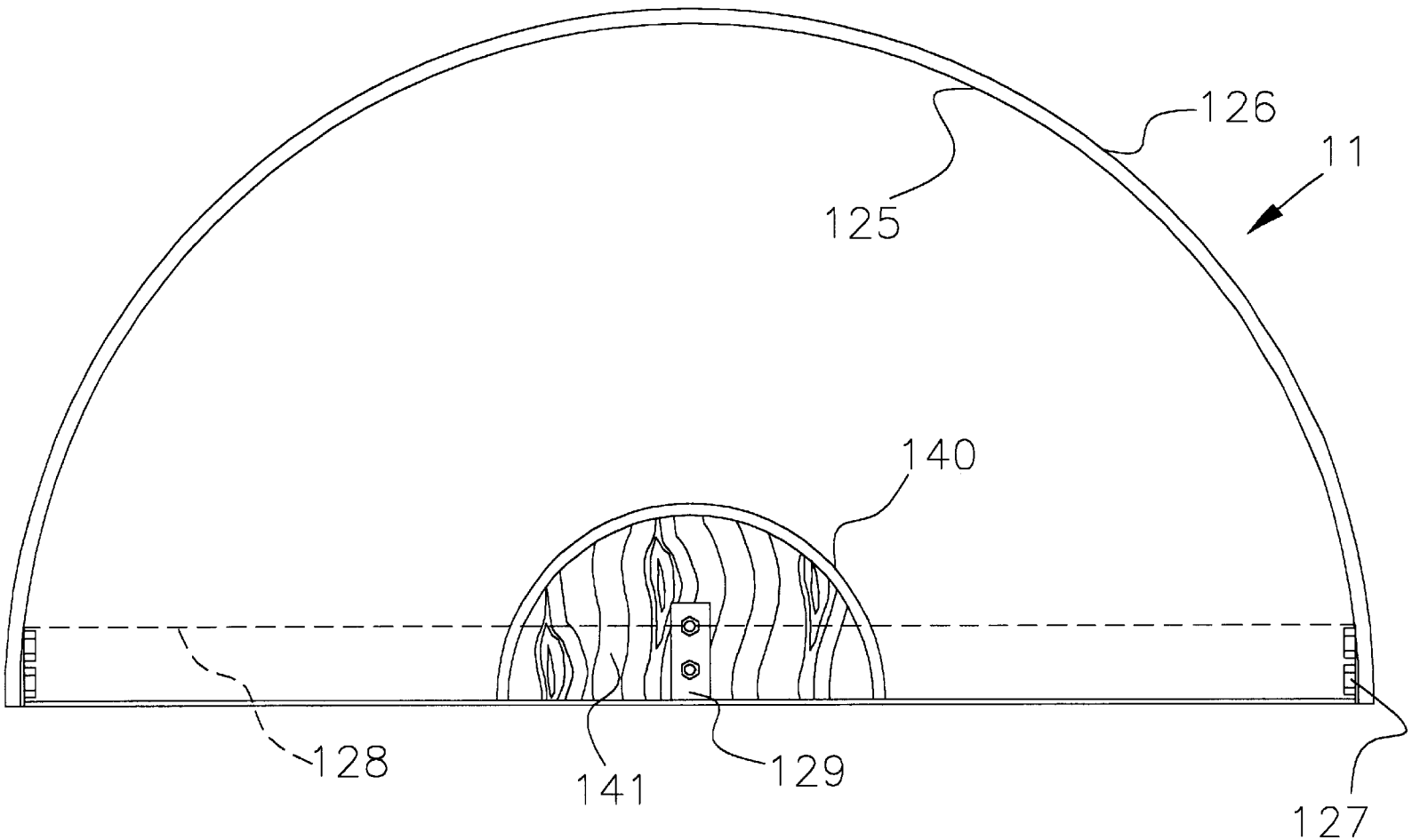
FIG. 6 is a front elevational view of the curved mount and base support of a further embodiment of present invention
Figure 7:
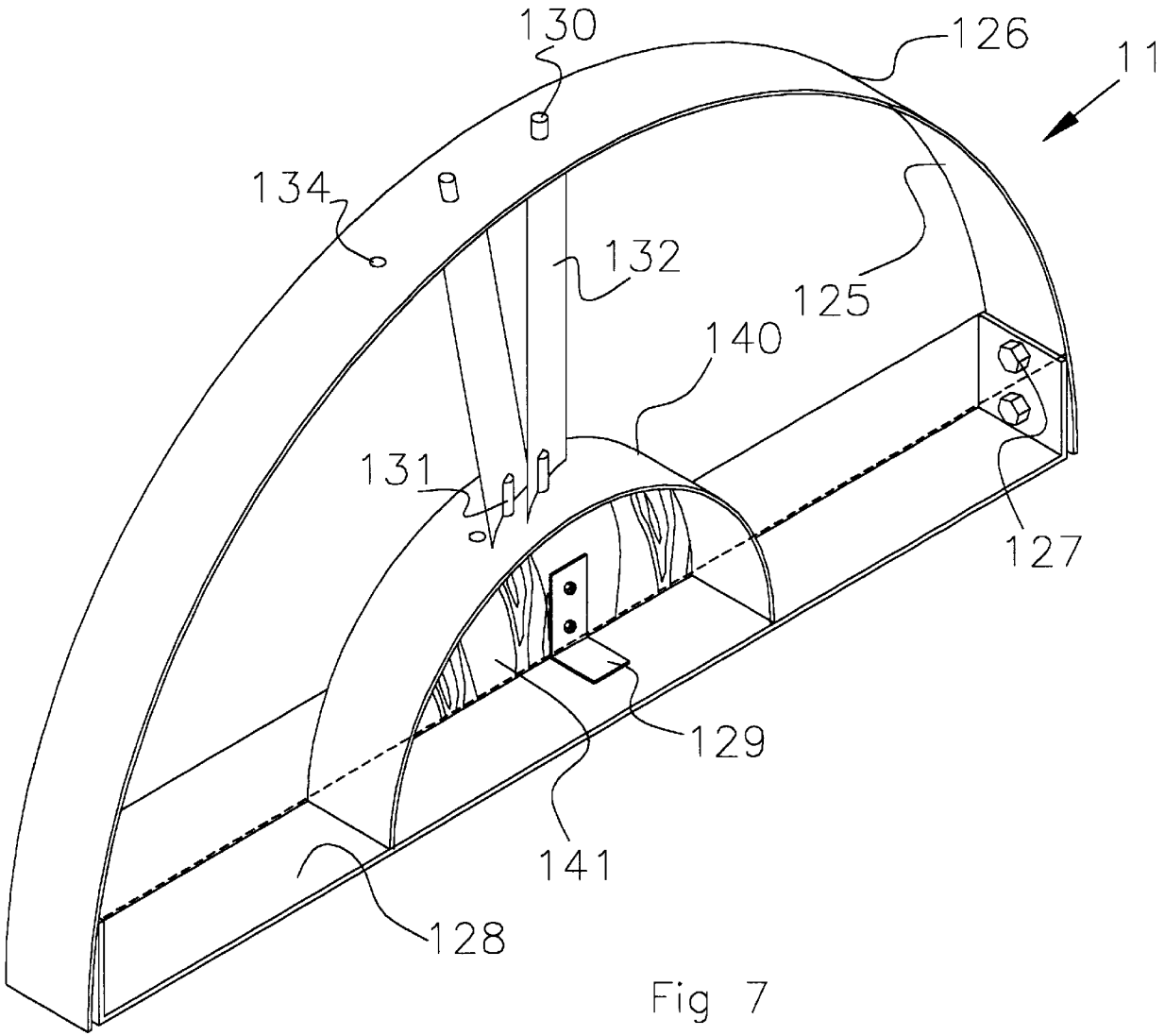
FIG. 7 is an isometric view of the curved mount, base support and mounting hardware of the further embodiment of the present invention.
Figure 8:
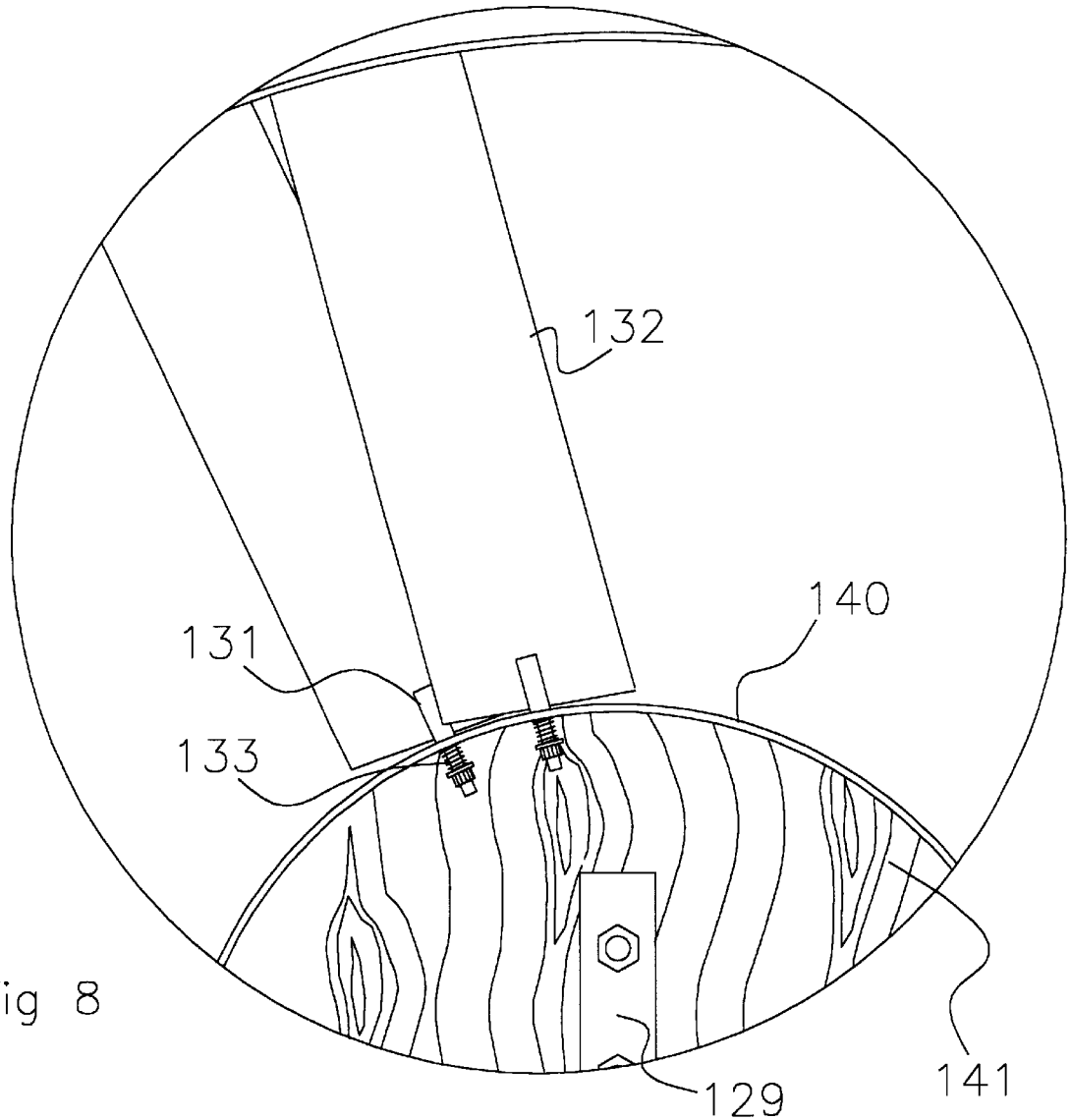
FIG. 8 is an enlarged view of the blind mounting hardware of the further embodiment of the present invention.
Figure 9:
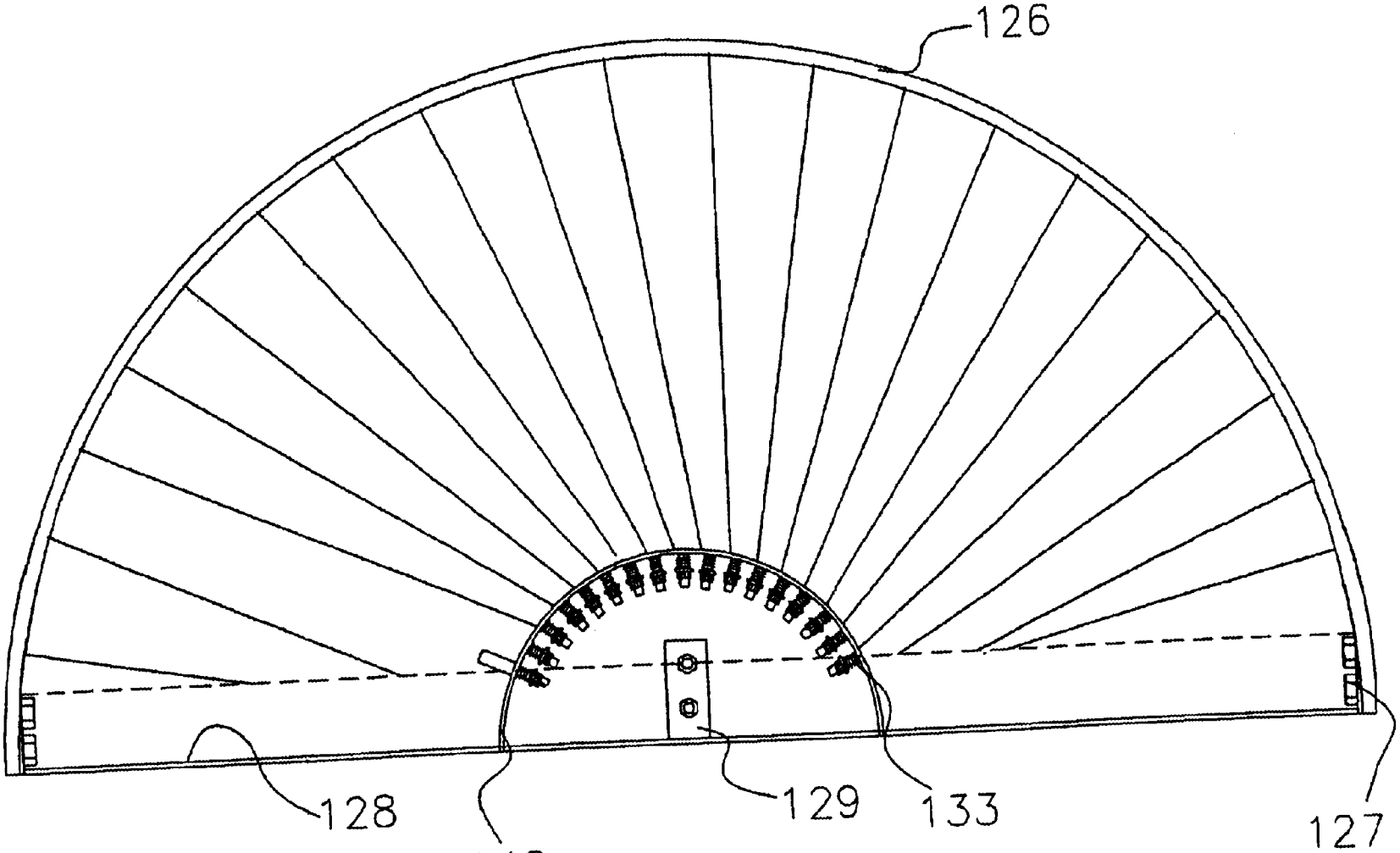
FIG. 9 is an elevational view of the further embodiment of the present invention showing the blind slats in place within the curved mount.
Figure 10:
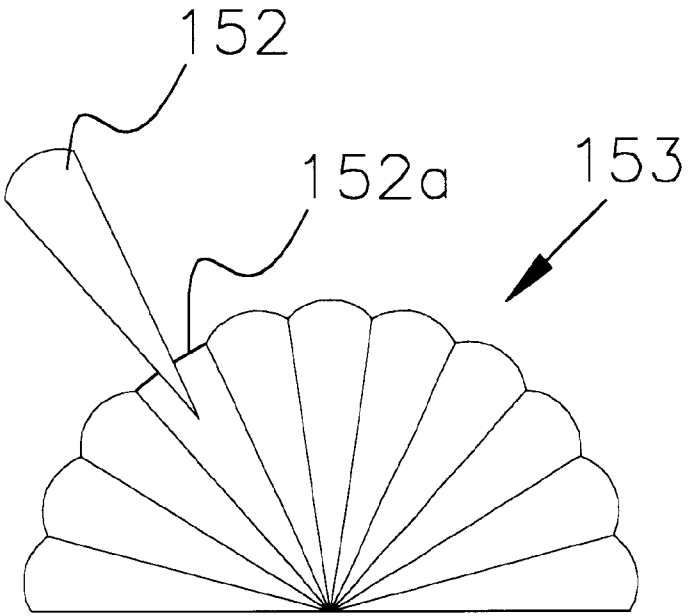
FIG. 10 is an elevational view of the decorative rosette used to cover the mounting hardware of the further embodiment of the present invention.
Figure 11:
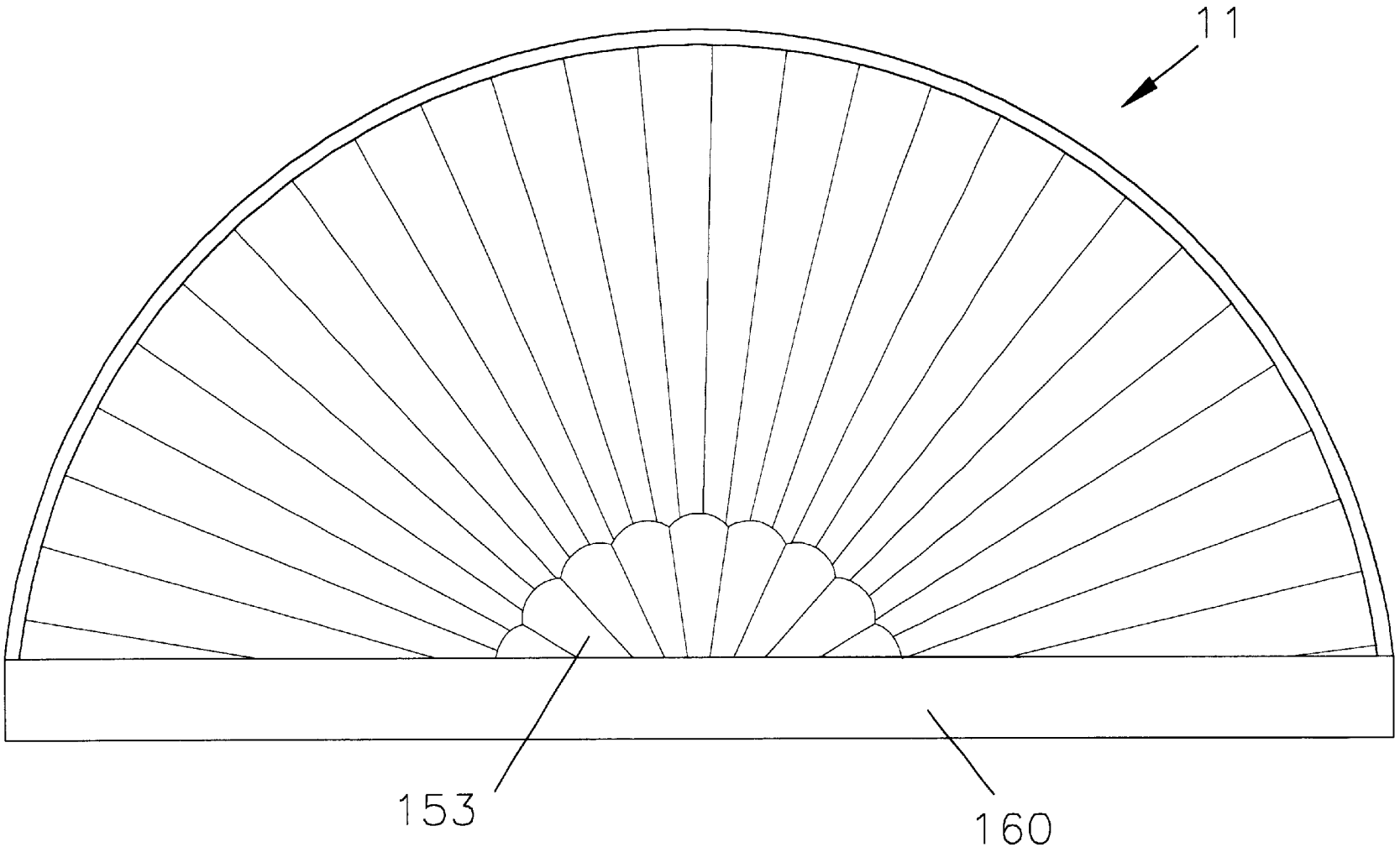
FIG. 11 is an elevational view of the further embodiment of the present invention. as it would appear completely assembled.
Figure 12:
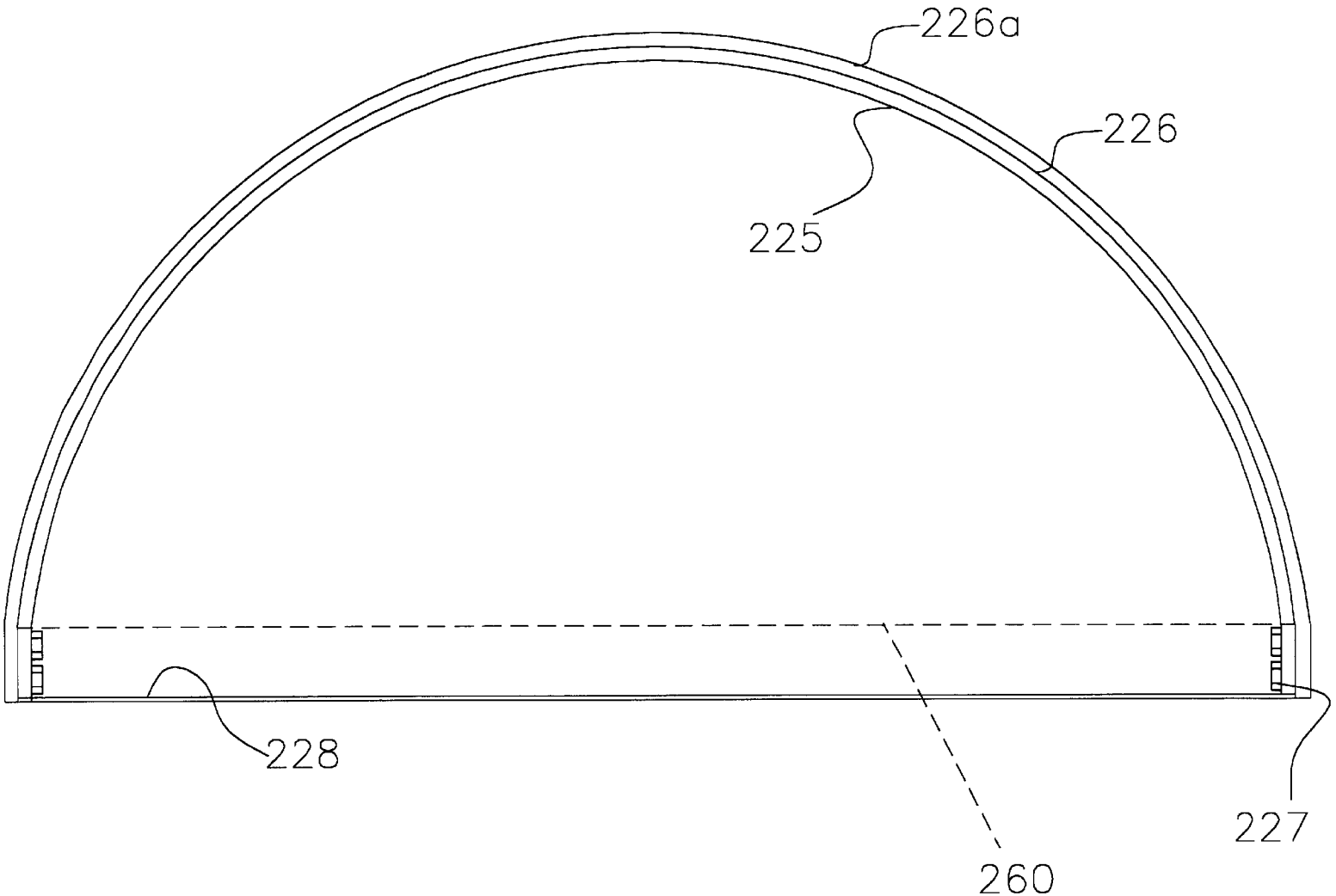
FIG. 12 is an elevational view of the curved mount and base support of a further embodiment of the present invention.
Figure 13:
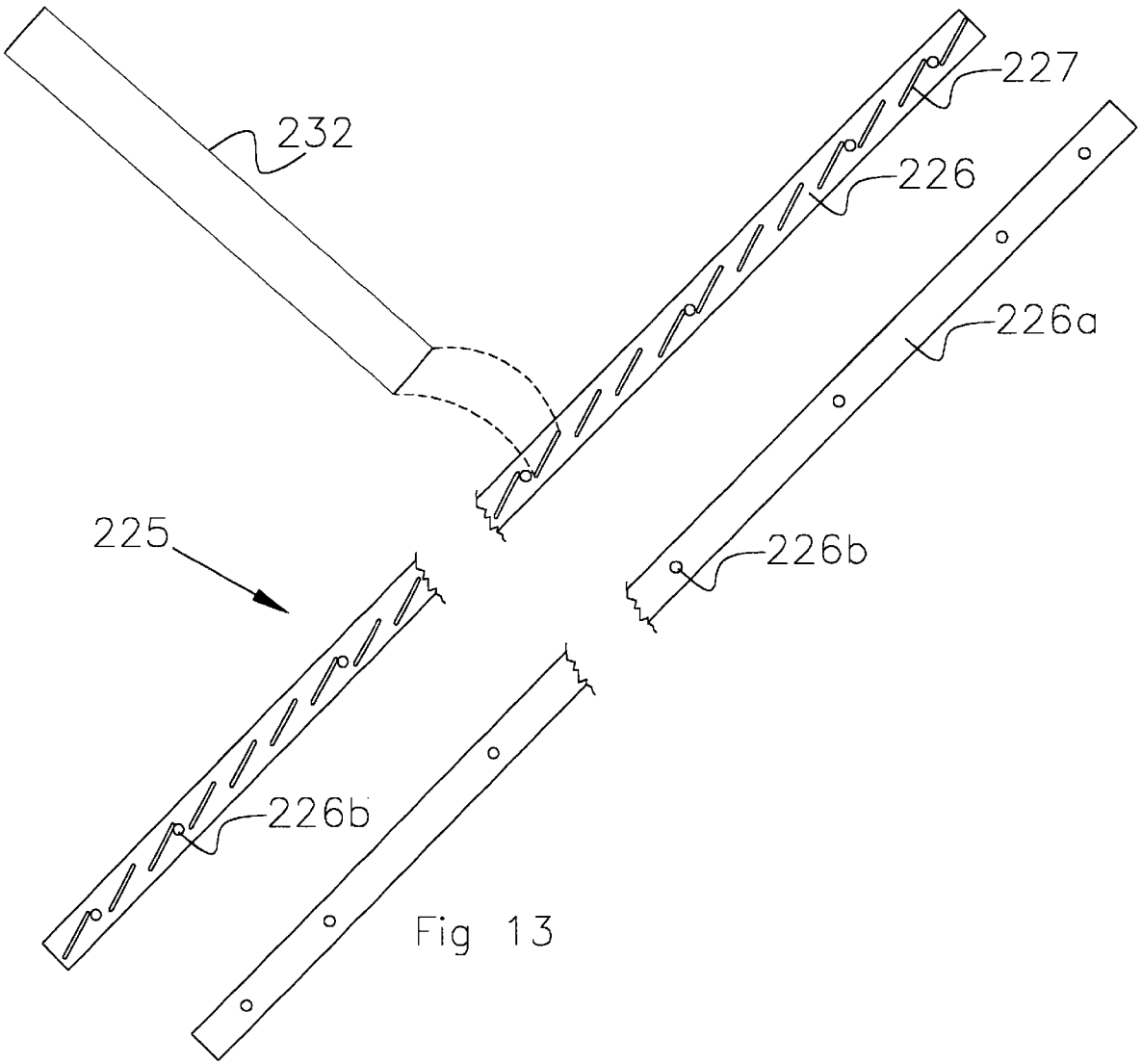
FIG. 13 is a top view of the slotted flexible tracks and blind slat of the further embodiment of the current invention.

The blind 10 of the present invention includes a plurality of vertical blind sections 23 rotatably suspended at their top end from a plurality of radially spaced support pins 25 attached to arched mount 14 as shown FIG. 2. In FIG. 2*a* enlargement blind slat 23 is rotatably suspended from drive pin 26 and drive chain 27 extends down in an endless loop through guide assembly 30. In FIG. 2*b* enlargement drive chain connects to gear 31. Drive pin 26 connects to blind clip 29 from which blind 23 is rotatably suspended at pivot 33. In FIG. 3 endless drive chain 27 connects to drive gear 31 to provide rotational force to said drive gear. In FIGS. 4 and 5 a plurality of idler gears 31*a* gives support to chain 27 and forms the inner mechanism of guide assembly 30.

Description of a Further Embodiment

Refering now to FIGS. 6–11 wherein semi adjustable blind assembly for semicircular windows is referenced overall by the numeral 11. In FIGS. 6–11 arched mount 126 has an inner face 125 through which a plurality of holes 134 rotatably supports retaining pins 130 and 131 connected to blind slats 132. Tension spring 133 pulls blind slat 132 tightly against the face of support 140. Flexible slat material is thus formed into a rigid column which can be manually rotated into position and thereby forming a semi adjustable blind assembly for semicircular windows. Mounting hardware 127, channel 128, arch support 129 support 140 and panel 141 form a secure base for arched mount 126. Decorative rosette 153 formed by a plurality of tapered sections 152 and valence slat 160 decoratively hides all mounting and other hardware of blind 11.

Description of a Further Embodiment

Figure 14:
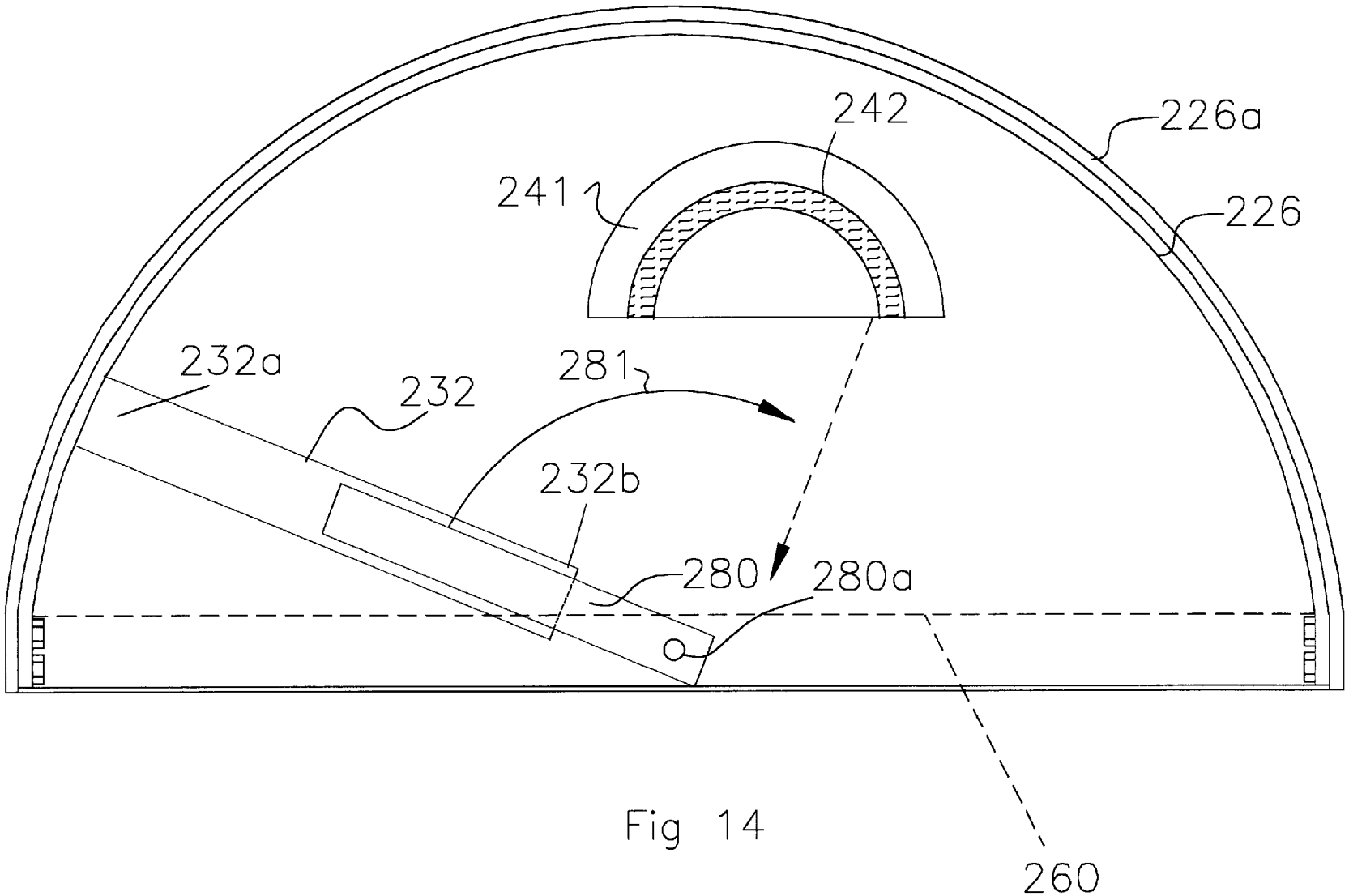
FIG. 14 is a diagrammatic front elevation of the further embodiment of the current invention.
Figure 15:
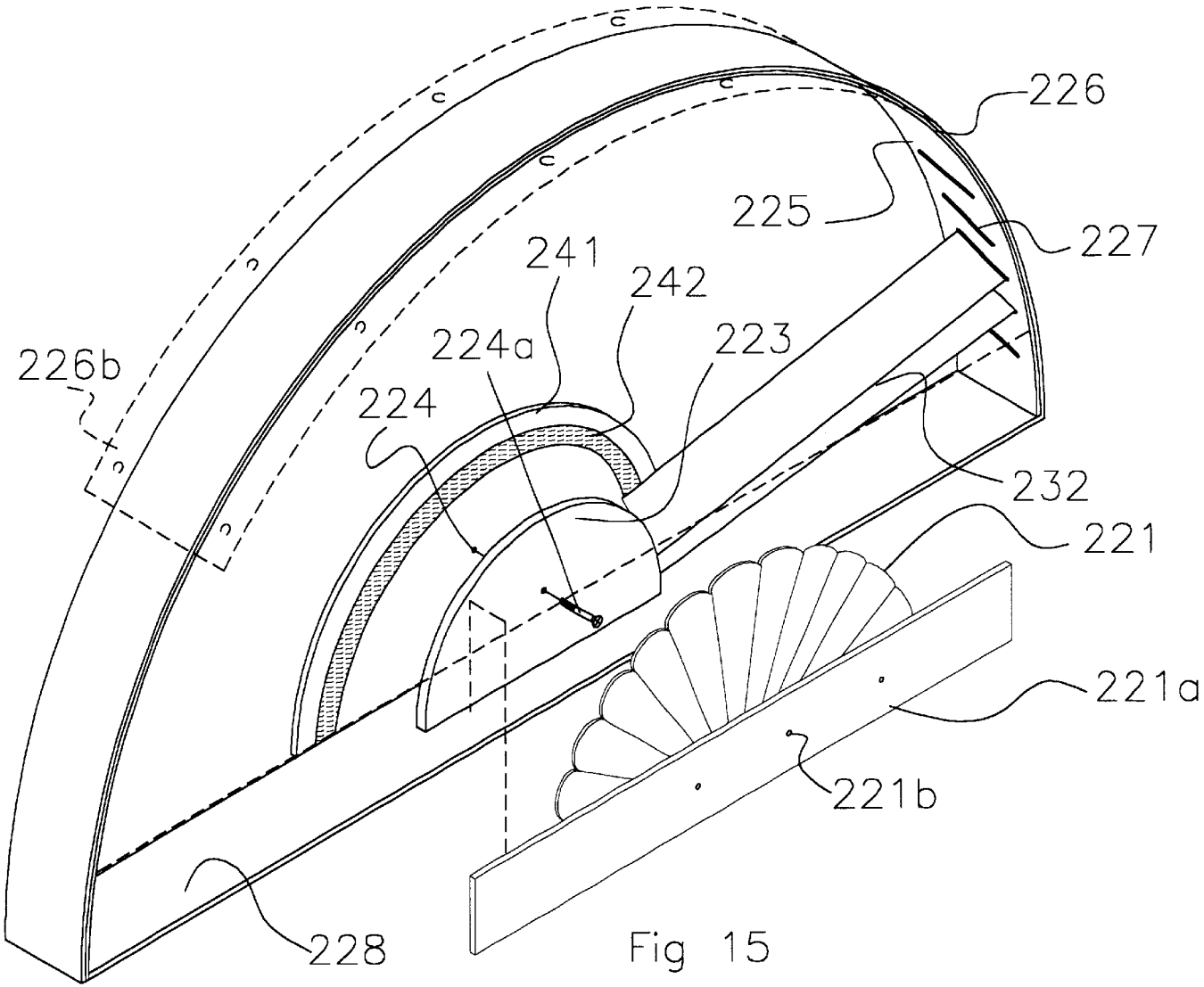
FIG. 15 is an isometric view of the curved mount, base support and mounting hardware of the further embodiment of the present invention.

Referring now to FIGS. 12–15 wherein fixed slat semicircular blind is designated overall by the numeral 12 flexible mount 225 is pierced along inner face 226 with a plurality of angled slots 227 into which blinds 232 are offered up and fixed at the top ends 232*a* and secured at their lower ends 232*b* to base 228 to form a radial array within the arch formed by face 226. In this embodiment, during initial installation/assembly, track 226*a* is first secured within the window arch by screws through holes 226*b*. Once track 226*a* is in place, arch 226 is clipped in place and secured by screws through holes 226*b*. Once arch 226 is in place, base channel 160 is fitted and secured with screws 227. Referring now to FIG. 14, backing plate 241 is attached to base channel 260 and temporary alignment tool 280 is affixed at pivot point 280*a*. As blinds 232 are put in place, alignment tool 280 being rotatably attached at pivot point 280*a* turns in the direction of arrow 281 to provide a means whereby said slats can be correctly positioned. Referring now to FIG. 15, as slats 232 are attached at one end by slots 227, they are attached at the other end by Velcro patches to Velcro strip 242. once all slats 232 are in place, alignment tool 28 is removed and clamp plate 223 is attached by screw 224*a* to backing plate 241 at hole 224. This effectively "sandwiches" the slats together. As a final assembly step, decorative rosette 221 is placed in channel 260 and sits in bottom face 228 thereof. Face plate 221*a* has screw holes 221*b* for attachment to channel 260.

Figure 16:
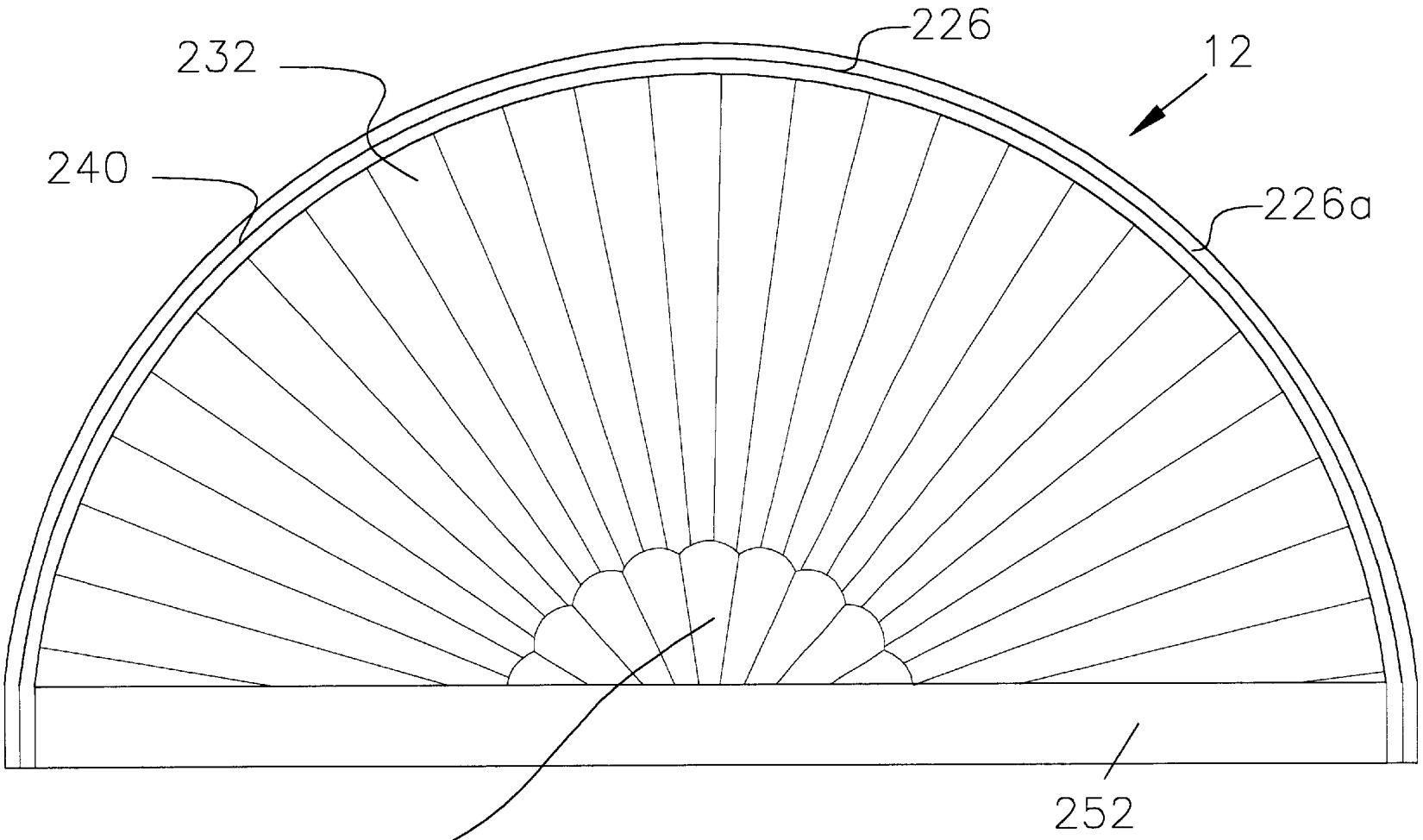
FIG. 16 is a diagrammatic front elevation of the further embodiment of the current invention as it would appear fully assembled
Figure 17:
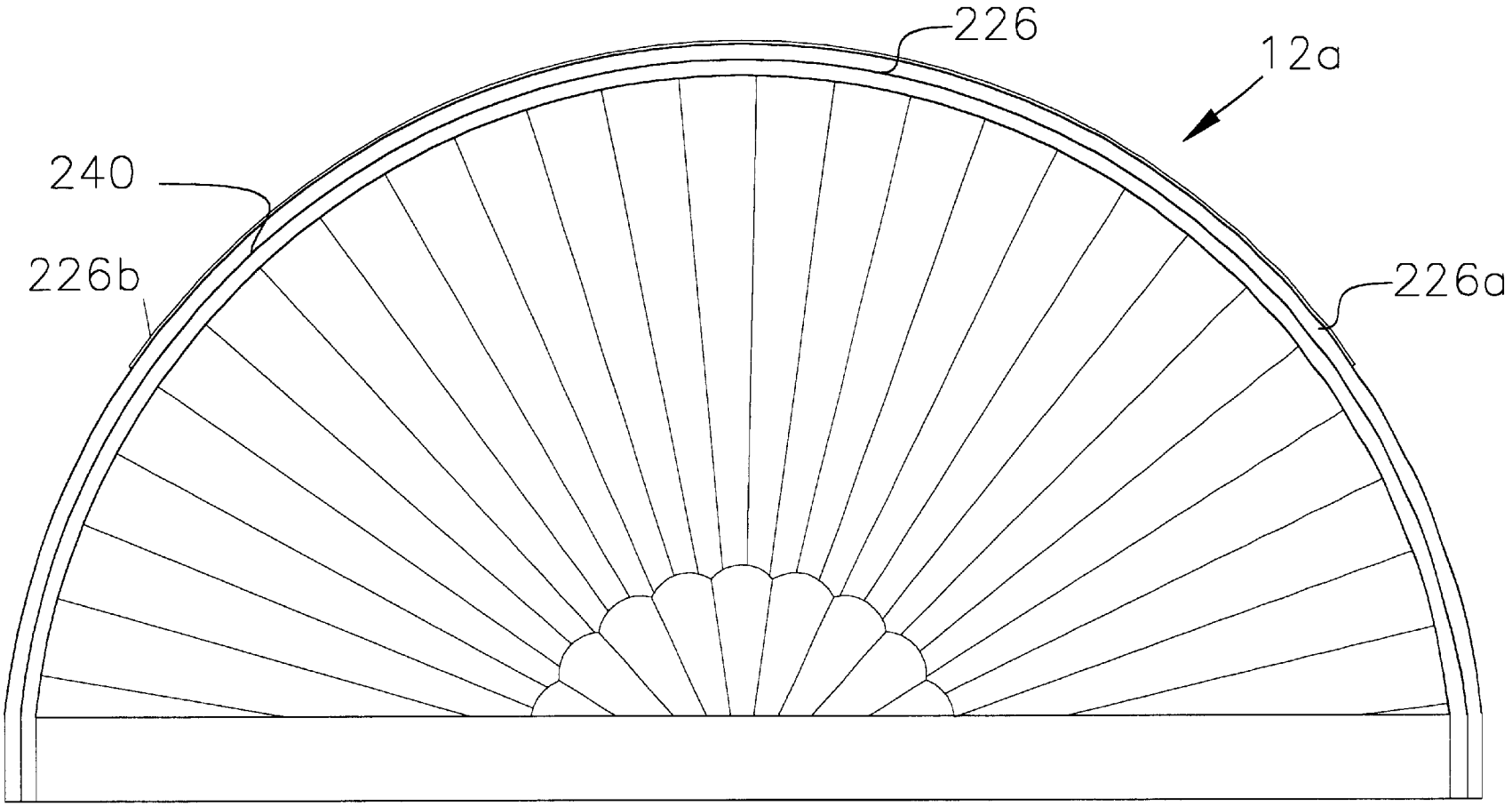
FIG. 17 is a diagrammatic front elevation of the further embodiment of the current invention as it would appear fully assembled

Referring now to FIG. 16, the assembled semicircular blind 12 is now complete. Referring again to FIG. 15, an attachment slat 226*b* can be affixed to a pre-assembled semicircular blind 12 as shown in FIG. 17. This provides the option of supplying the semicircular blind 12 in an assembled form or in kit form as described in the assembly sequence above.

Decorative rosette 250, valence strip 252 cover all mounting hardware and provide decorative finish.

Description of a Further Embodiment

Figure 18:
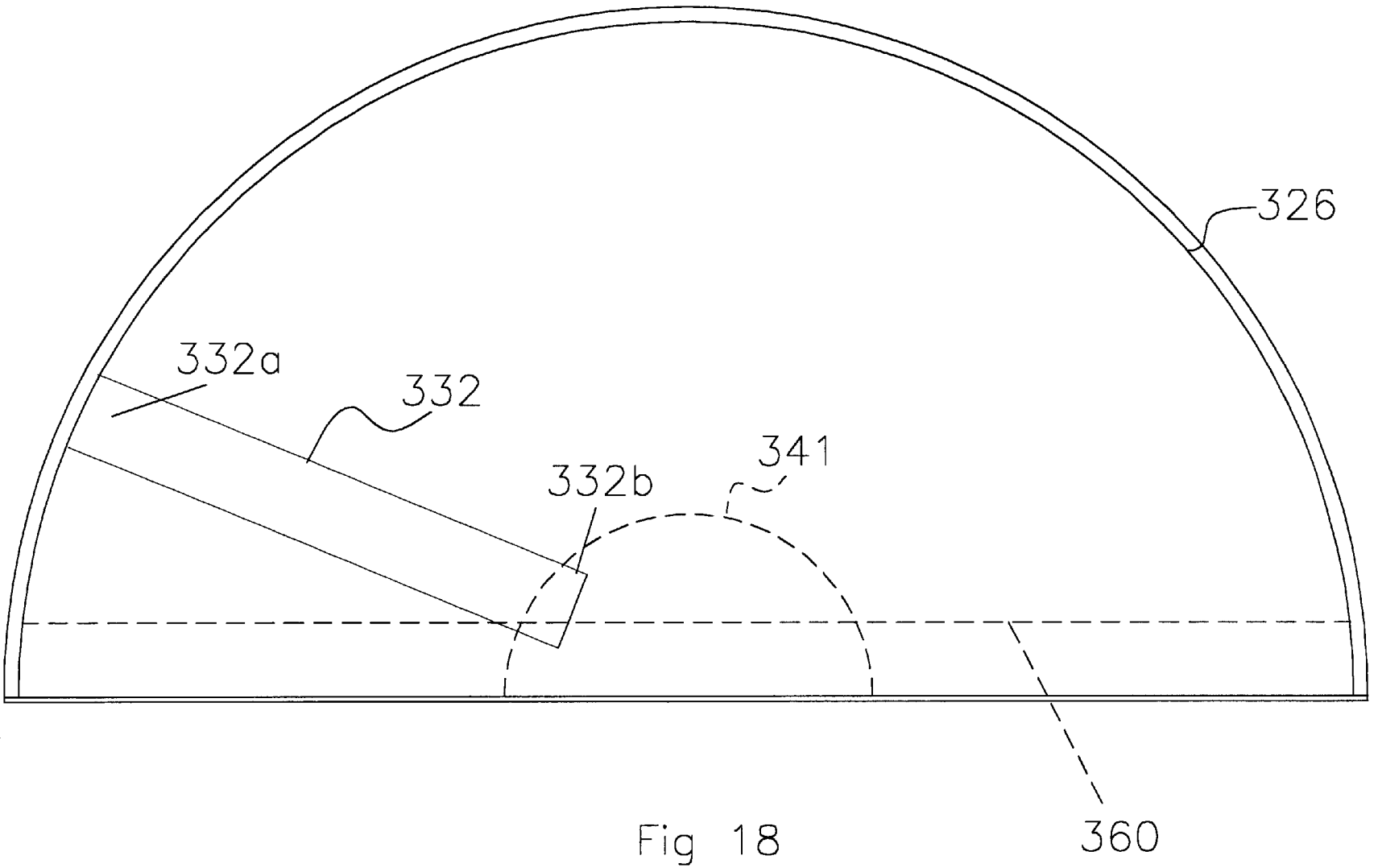
FIG. 18 is a diagrammatic front elevation of a further embodiment of the current invention.

Referring now to FIG. 18, in this diagrammatical representation of the previously described embodiment, as a variation on assembly/attachment methods for blind slats 332, in this embodiment, the slats 332 are held in place at inner face 326 at fixed end 332*a* simply by compression one against the other within channel 360 and backing plate 34. Critical to this operation is the trimming of each slat at end 332*b* Said trimming is applied to each slat end such that the length of each slat is reduced by ¼" (See also FIGS. 19*a*–19*b*) This is done to remove bulk which would preclude the fitting of all of slats 332 within channel 360.

Description of a Further Embodiment

Figures 18A, 19:
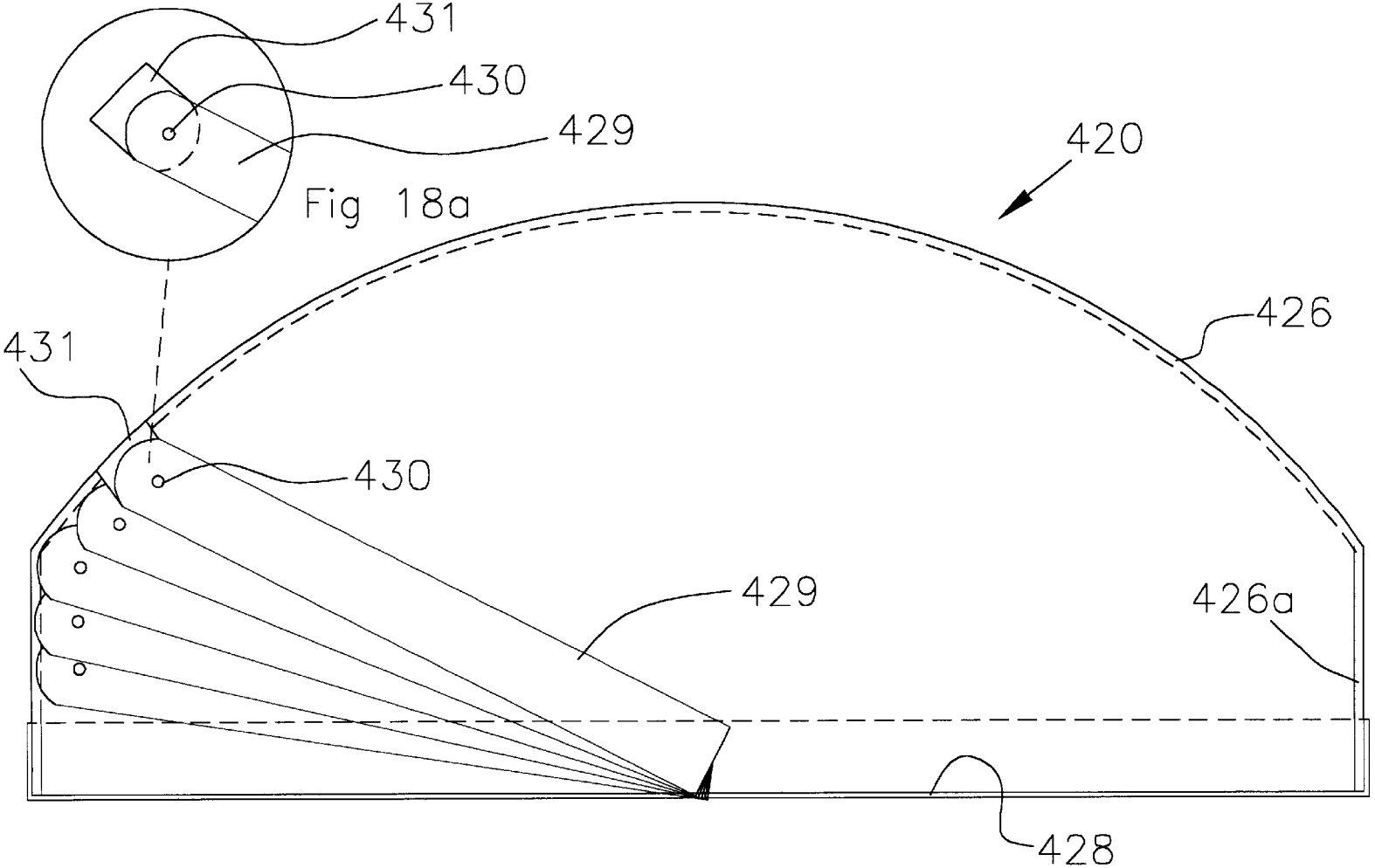
FIG. 18*a* is an enlargement of a section of diagrammatic front elevation shown in FIG. 18.
FIG. 19 is a front elevational view of a further embodiment of the current invention.
Figure 19A:
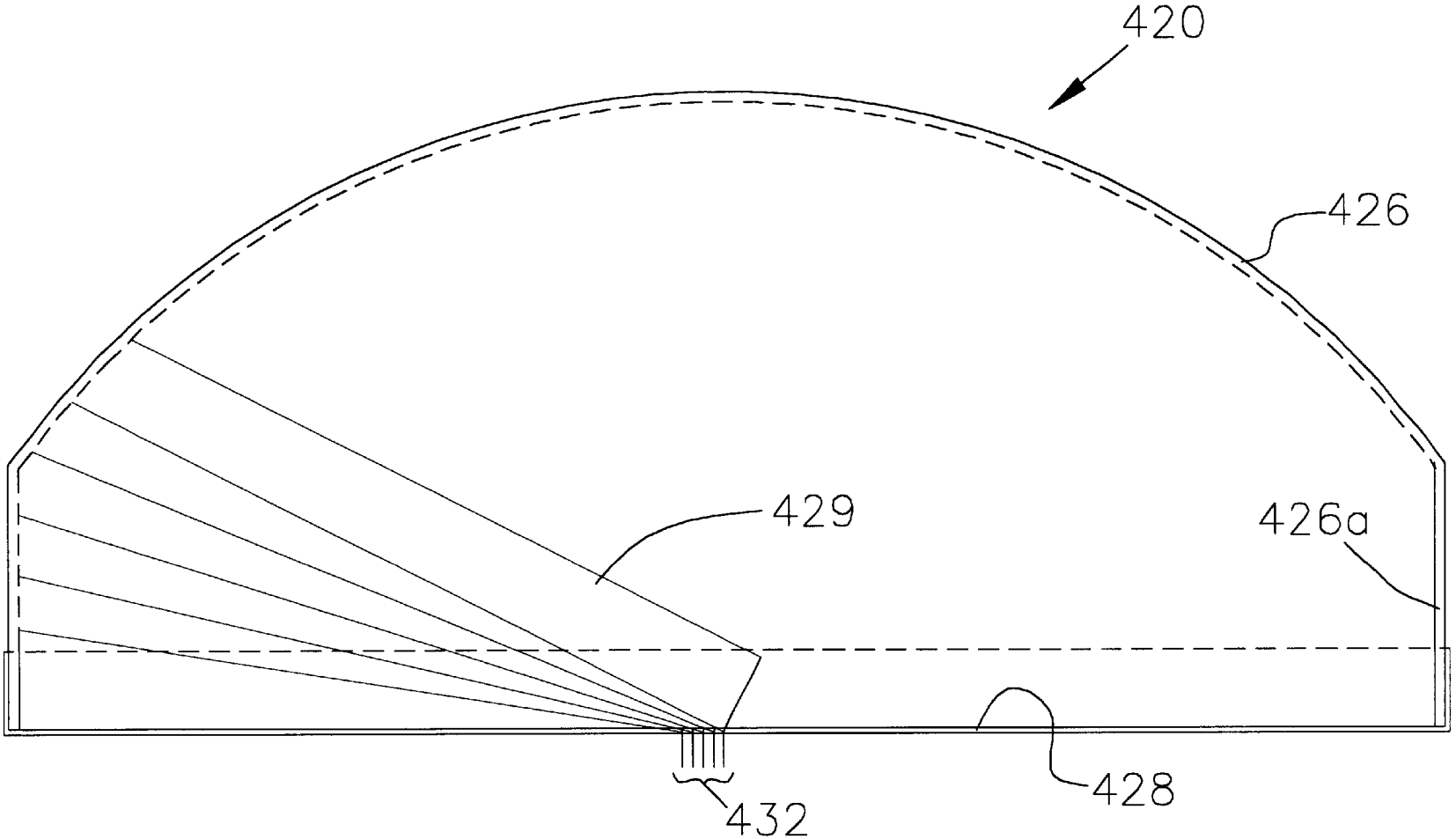
FIGS. 19*a* and 19*b* are front elevations partially in section of the further embodiment showing the method used to cut back blind slats.
Figure 19B:
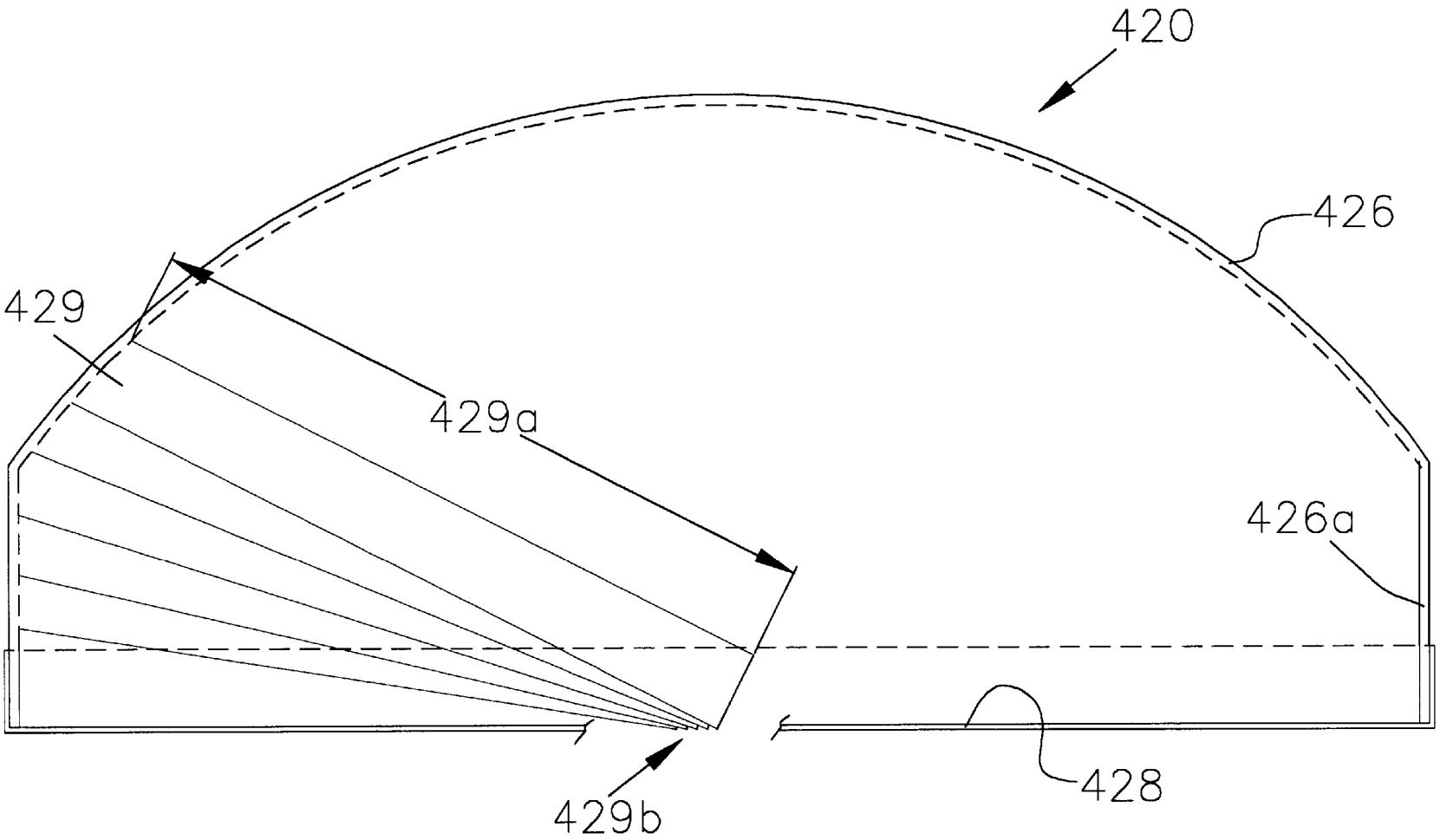

Referring now to FIG. 19 wherein fixed slat blind is designated overall by the numeral 420. Curved channel 426 and straight channel 426*a* can accommodate slats 429 by reason of pivot slat end 431 attached to slat 429 at pivot 430. In assembly, slats 429 are positioned in the manner described in the earlier embodiments, the difference in this embodiment being only the shape of the window arch. Channel 428 encases slats 429 either by compression within channel 428 or by compression between plates as in the other embodiments. As shown in FIG. 18, slats are trimmed incrementally to allow them to fit into channel 428. Said trimming is applied to each slat end such that the length of each slat is reduced by ¼" or a greater or lesser amount to produce a slat length which will permit the slats to fit within the confines of channel 428. Referring now to FIG. 19*a*, slat 429 (in this instance without pivot slat end 431) measure increments 432 show the reduction in length of each slat 429. The effect of such trimming is more clearly seen in FIG. 19*b* where slat length 429*a*, is incrementally reduced 429*b*.

Description of a Further Embodiment

Figure 20:
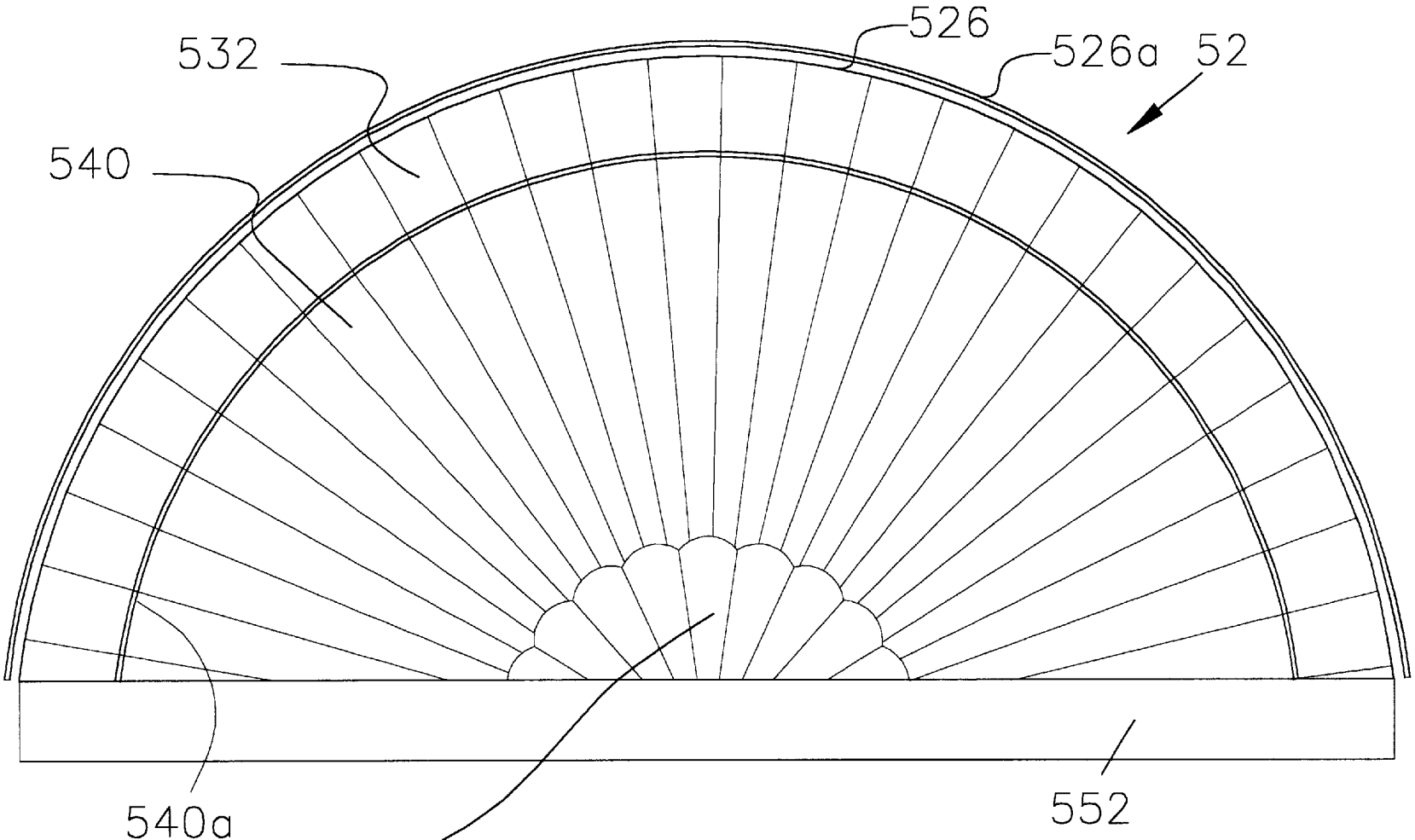
FIG. 20 is an elevational exploded view of a further embodiment of the present invention.

Referring now to FIG. 20 wherein fixed slat semicircular blind is designated overall by the numeral 52. Blind slats 540 are attached radially within curved frame 526 and affixed identically as described herein for FIGS. 12–15. FIG. 15 shows additionally, decorative panels 532, radially arrayed around the periphery of curved frame 526 and face plate 552. Decorative trim 526, 540*a* and decorative rosette 550 are constructed from the same slat material as slats 540 and panels 532.

Description of a Further Embodiment

Figure 21:
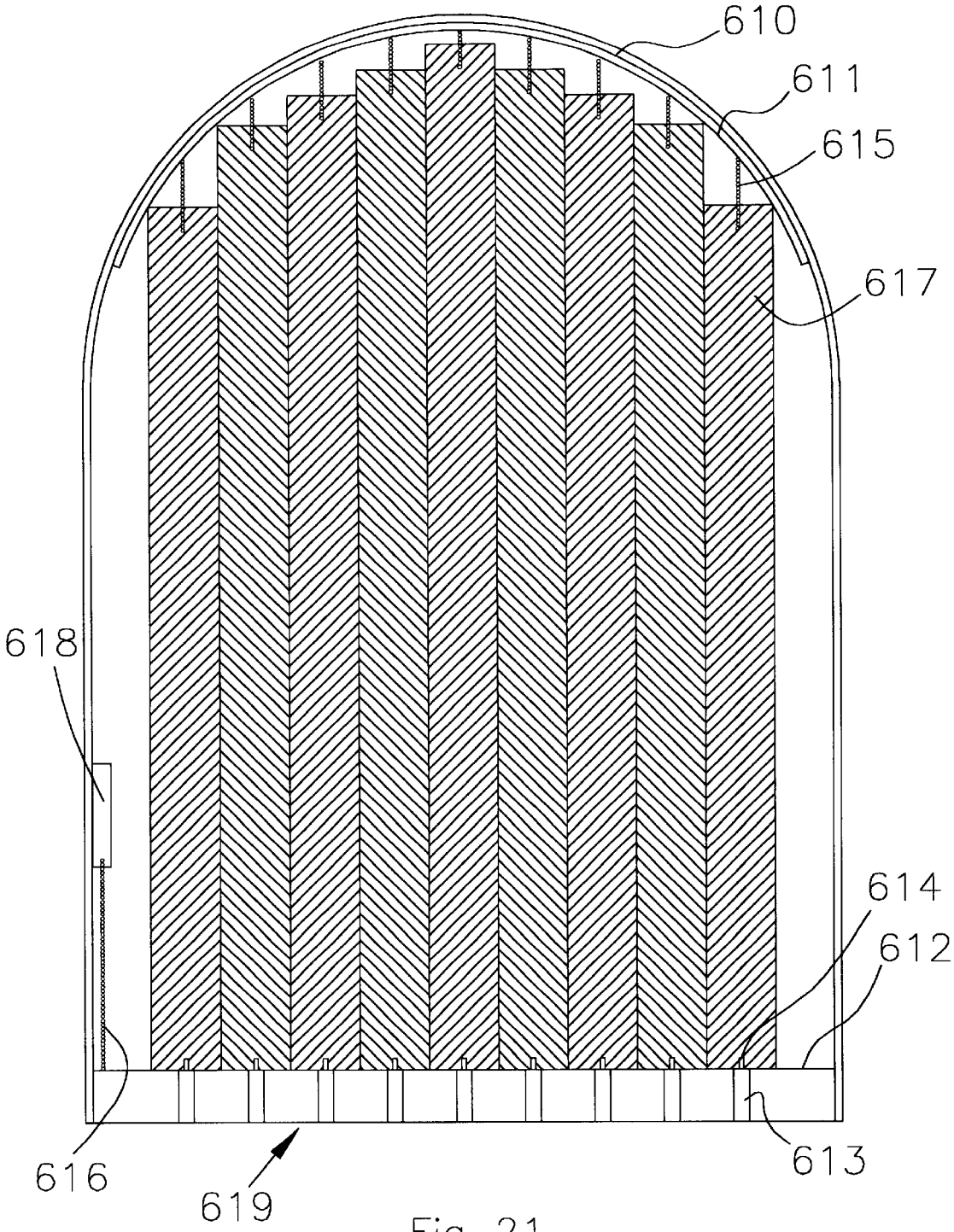
FIG. 21 is a front elevational view of a further embodiment of the current invention.

Referring now to FIG. 21 wherein outer arched frame 610 supports adjustment support 661. Vertical slat blinds 617 are supported at their top ends by ball chain 615 and the bottom ends in channel 612 by clip attachment 614 and retaining pin 613 connecting each blind to commercial adjustable blind track designated overall by the numeral 619. Adjustable chain support 618 connects chain 616 to blind track 619 whereby slats can be rotationally adjusted around the axes of ball chains 615 and clip attachments 614 and axially adjusted by sliding ball chains 15 in their mounting slots in adjustment support 611.

What is claimed is:

1. In combination with a substantially semi-circular window having a straight bottom edge, a blind comprising a plurality of vertical slats of semi-rigid shape sustaining material rotatably suspended from a plurality of shafts, said shafts being rotatably attached to a plurality of sprockets, said sprockets being rotated by an endless ball chain, said shafts being radially attached and suspended from a semi-circular support frame, said frame consisting of a "U" section of flexible material attached to and in general conformity with said semi-circular window, bracketing means for supporting said support frame at the bottom edge of the window, said bracketing means having an attached guiding means for said endless ball chain.

2. The combination as defined in claim 1 together with a semi-circular fascia overlaying and concealing the surfaces of said semi-circular support frame, said vertical shafts, and said sprockets, said fascia having a horizontal section concealing said bracket means.

3. In combination with a substantially semi-circular window, a blind having a straight peripheral portion and a curved peripheral portion, said blind comprising a rigid one-piece mounting means, supporting means adapted to support said mounting member from the straight peripheral portion of the window, a semi-circular hub of reduced diameter, said hub being centrally attached to said mounting means, said hub having an upper curved surface and a lower curved surface, said peripheral portion and said hub being pierced by a plurality of radial holes, said holes in said hub having axial alignment with said holes in said curved peripheral section, a plurality of slats of semi-rigid shape sustaining material having distally and proximally attached protuberances and proximally attached retaining springs and keepers, said slats being radially arrayed between said hub and said curved peripheral portion, said springs and keepers being attached to said proximal protuberances as a tensioning means against said lower surface of said hub, said slats being kept in tension thereby, a decorative rosette having a plurality of tapered sections, said sections having a semi-circular distal end and a pointed proximal end, and a semi-circular backing surface of rigid material, said sections being radially arrayed around said backing surface, a decorative fascia overlaying and concealing the surface of said straight peripheral portion and said curved peripheral portion.

4. In combination with a substantially semi-circular window having a straight bottom edge, a blind having a straight peripheral portion, a support frame and a curved peripheral portion, said blind comprising a rigid "U" shaped one-piece mounting means, adapted to support said mounting member from the straight peripheral portion consisting of a "U" section of flexible material attached to and in general conformity with said semicircular window, bracketing means for supporting said support frame at the bottom edge of the window, a plurality of slats of semi-rigid shape sustaining material radiating from a central portion of said straight peripheral portion, each of said slats having a proximal attachment patch, a first end and a second end, said curved peripheral portion having a radially arrayed plurality of angled slots, said first end of said slats extending to said angled slots in said curved peripheral portion and being affixed therein, a semi-circular backing surface of rigid material having a semi-circular strip of attachment material, said second end of said slats being trimmed at said second end to reduce the length of each slat thereby removing bulk, each of said second ends being affixed proximally to said strip, a pivotal alignment means attached at a central portion of said straight peripheral portion, said slats being placed in adjusted position by alignment with said alignment means, a semi-circular pressure plate of rigid material centrally screwed through the proximal ends of said slats to said semi-circular backing surface, said slats being held in adjusted position thereby, a decorative rosette assembly having a horizontal rectangular mounting plate, said decorative rosette covering said pressure plate.

5. The blind as defined in claim 4 wherein said blind is installed in location in sequence as a kit.

6. The blind as defined in claim 4 wherein said blind is pre-assembled and installed in location, said blind having accessible tabs as attachment means.

7. The blind as defined in claim 4 wherein the slats of said blind are affixed at their proximal ends by their accumulated thickness being under pressure between the sides of said "U" shaped one-piece mounting means.

8. The blind as defined in claim 4 wherein said blind is uniformly decorated over each exposed surface using said semi-rigid shape sustaining material as said vertical slats.

9. In combination with a substantially semi-circular window having a straight peripheral portion, a curved peripheral portion and a support frame, a blind comprising a rigid "U" shaped one-piece mounting means, supporting means adapted to support said mounting member from the straight peripheral portion of the window, said curved peripheral portion consisting of a "U" section of flexible material attached to and in general conformity with said semi-circular window, two vertical support members adjoining said straight and said curved portions, bracketing means for supporting said support frame at the bottom edge of the window, said curved peripheral portion having a radially arrayed plurality of angled slots, a plurality of slats of semi-rigid shape sustaining material radiating from a central portion of said straight peripheral portion, said slats having a proximal end and a distal hinged extension, said extension to retain said slats in adjusted position within said angled slots, a decorative rosette covering said proximal ends of said slats.

10. In combination with a substantially semi-circular window having a straight bottom edge, a blind comprising a plurality of vertical slats of semi-rigid shape-sustaining material rotatably and pivotally suspended from a plurality of ball chain sections, said chain sections being rotatably attached to a plurality of slots, said slots permitting the radial adjustment of said ball chains and said slats, said slats being rotatably affixed at the proximal ends to a common vertical blind adjustment track, said track having a plurality of vertical shafts, said shafts having a first top slotted end and a second bottom end, said bottom end having a sprocket, said sprocket being rotated by an endless ball chain, bracketing means for supporting said support frame at the bottom edge of the window, said bracketing means having an attached guiding means for said endless ball chain.

* * * * *